US010751562B1

(12) United States Patent
Chen

(10) Patent No.: US 10,751,562 B1
(45) Date of Patent: Aug. 25, 2020

(54) CLIMBING MACHINE

(71) Applicant: Hsien Chu Chen, Taichung (TW)

(72) Inventor: Hsien Chu Chen, Taichung (TW)

(73) Assignee: CHUAN SHENG ELECTRIC CO., LTD, Taichung (TW)

( * ) Notice: Subject to any disclaimer, the term of this patent is extended or adjusted under 35 U.S.C. 154(b) by 0 days.

(21) Appl. No.: 16/354,248

(22) Filed: Mar. 15, 2019

(51) Int. Cl.
*A63B 22/04* (2006.01)
*A63B 21/015* (2006.01)
*A63B 23/04* (2006.01)

(52) U.S. Cl.
CPC ..... *A63B 22/04* (2013.01); *A63B 21/015* (2013.01); *A63B 23/0405* (2013.01)

(58) Field of Classification Search
CPC .... A63B 22/04; A63B 21/015; A63B 23/0405
See application file for complete search history.

(56) References Cited

U.S. PATENT DOCUMENTS 3,592,466 A * 7/1971 Parsons ..... A63B 22/0023 482/53
4,496,147 A * 1/1985 DeCloux ..... A63B 21/0083 482/113
4,708,338 A * 11/1987 Potts ..... A63B 21/023 482/52
4,726,581 A * 2/1988 Chang ..... A63B 22/04 482/113
4,998,725 A * 3/1991 Watterson ..... A63B 21/015 345/38
5,139,470 A * 8/1992 Wang ..... A63B 21/0083 482/113
5,180,351 A * 1/1993 Ehrenfried ..... A63B 21/154 482/51
5,207,621 A * 5/1993 Koch ..... A63B 22/0056 482/112
5,242,341 A * 9/1993 Yeh ..... A63B 22/04 482/52
5,328,427 A * 7/1994 Sleamaker ..... A63B 21/154 482/110
5,352,166 A * 10/1994 Chang ..... A63B 22/04 482/37
5,403,252 A * 4/1995 Leon ..... A61B 5/221 482/5
5,685,804 A * 11/1997 Whan-Tong ..... A63B 22/001 482/51
5,769,759 A * 6/1998 Alter ..... A63B 22/04 482/37

(Continued)

*Primary Examiner* — Garrett K Atkinson

(57) ABSTRACT

A climbing machine includes two sets of two inclined parallel rails disposed on a base and frame assembly; two pedals slidably disposed on the sets of the rails respectively; a transmitting device including an axle disposed under front portions of the sets of the rails and oriented in a direction perpendicular to a virtual plane defined by the sets of the rails, a first sprocket disposed around the axle, a second sprocket disposed adjacent to a center of a bottom of a rear end of the base and frame assembly, and a disc shaped damping member with the first sprocket mounted in its center; and a belt meshing with the first and second sprockets, the belt 28 being parallel to the sets of the rails. The pedals are secured to the belt and disposed at two sides of the first and second sprockets respectively.

9 Claims, 10 Drawing Sheets

(56) References Cited

U.S. PATENT DOCUMENTS 6,036,622 A * 3/2000 Gordon ..... A63B 21/154 482/51
6,146,313 A * 11/2000 Whan-Tong ..... A63B 22/001 482/51
6,482,130 B1 * 11/2002 Pasero ..... A63B 22/001 482/51
6,905,441 B2 * 6/2005 Anderson ..... A63B 22/205 482/51
6,939,271 B1 * 9/2005 Whan-Tong ..... A63B 22/001 482/52
7,153,238 B2 * 12/2006 Anderson ..... A63B 22/205 482/52
7,594,877 B2 * 9/2009 Anderson ..... A63B 21/154 482/51
7,731,635 B2 * 6/2010 Dyer ..... A63B 22/0664 482/52
7,780,577 B2 * 8/2010 Arnold ..... A63B 22/001 482/51
7,815,549 B2 * 10/2010 Crawford ..... A63B 24/0087 482/52
7,887,464 B1 * 2/2011 Jones ..... A61H 1/0214 482/51
7,927,257 B2 * 4/2011 Patel ..... A63B 21/00181 482/142
8,277,366 B2 * 10/2012 Savane ..... A63B 22/0056 482/112
8,702,571 B2 * 4/2014 Fenster ..... A63B 22/04 482/52
8,974,353 B2 * 3/2015 Fenster ..... A63B 22/04 482/52
9,216,317 B2 * 12/2015 Golen, Jr. ..... A63B 22/04
9,238,158 B2 * 1/2016 Strommen ..... A63B 22/04
9,370,680 B1 * 6/2016 Macaulay ..... A63B 21/0552
9,789,355 B1 * 10/2017 Lo ..... A63B 22/04
9,993,682 B2 * 6/2018 Johnson ..... A63B 21/0051
10,105,568 B2 * 10/2018 Golen, Jr. ..... A63B 22/04
RE47,331 E * 4/2019 Fenster ..... A63B 22/04
10,532,247 B2 * 1/2020 Coray ..... A63B 24/0087
2003/0013583 A1 * 1/2003 Anderson ..... A63B 22/205 482/52
2005/0227817 A1 * 10/2005 Anderson ..... A63B 22/205 482/52
2006/0281604 A1 * 12/2006 Stewart ..... A63B 22/0023 482/51
2008/0125291 A1 * 5/2008 Watt ..... A63B 22/001 482/52
2010/0099541 A1 * 4/2010 Patel ..... A63B 21/00181 482/52
2011/0177917 A1 * 7/2011 Patel ..... A63B 23/0405 482/52
2012/0238409 A1 * 9/2012 Halsey ..... A63B 71/0619 482/52
2012/0264572 A1 * 10/2012 Fenster ..... A63B 21/0051 482/52
2015/0165263 A1 * 6/2015 Golen, Jr. ..... A63B 21/0058 482/7
2015/0190671 A1 * 7/2015 Golen, Jr. ..... A63B 21/0059 482/52
2015/0335974 A1 * 11/2015 Levesque ..... A63B 69/0048 482/2
2018/0326256 A1 * 11/2018 Coray ..... A63B 22/025
2019/0022455 A1 * 1/2019 Kueker ..... A63B 22/04
2020/0038706 A1 * 2/2020 Liu ..... A63B 23/03533
2020/0094106 A1 * 3/2020 Liu ..... A63B 22/205

* cited by examiner

CLIMBING MACHINE

BACKGROUND OF THE INVENTION

1. Field of the Invention

The invention relates to climbing machines and more particularly to a climbing machine including a transmitting device having an axle oriented in a direction perpendicular to a virtual plane defined by rails so that purposes including saving space and reducing the manufacturing cost of belt are obtained.

2. Description of Related Art

A conventional climbing machine is shown in FIG. 11 and comprises a base and frame assembly 40, two handlebars extending upward, rearward from the base and frame assembly 40, two sets of two inclined parallel rails 41 in which each rail 41 has one end secured to a joining portion of the handlebar and the base and frame assembly 40 and the other end rested on the ground, two pedals 42 slidably mounted on the rails 41 respectively, two guide wheels 43 mounted forwardly of the rails 41, a magnetic resistance controlling device 44 for adding difficulty to motion mounted between the base and frame assembly 40 and the rails 41 and including an axle 441 having a rotational direction the same as a moving direction of the rails 41, a roller 442 rotatably mounted on the axle 441, and a conductive disc 443 secured to the roller 442, and two belts 45 each extending from the guide wheel 43 to clockwise (or counterclockwise) wind around the roller 442. And in turn, the conductive disc 443 co-rotates with the roller 442.

However, in case the belts 45 are broken, it is very difficult of installing same since the belts 45 are wound around the roller 442. Further, the belts 45 are liable to breakage if the diameter of the roller 442 is relatively small. Furthermore, damping force increases as the diameter of the roller 442 increases. And in turn, the weight or the diameter of the conductive disc 443 increases. Thus, the magnetic resistance controlling device 44 is required to occupy a larger space. Disadvantageously, the manufacturing cost of the climbing machine may increase greatly and the climbing machine may take up a lot of space.

Thus, the need for improvement still exists.

SUMMARY OF THE INVENTION

The invention has been made in an effort to solve the problems of the conventional art by providing a climbing machine having novel and nonobvious characteristics.

To achieve above and other objects of the invention, the invention provides a climbing machine comprising a base and frame assembly; two sets of two inclined parallel rails disposed on the base and frame assembly; two pedals slidably disposed on the sets of the rails respectively; a transmitting device including an axle disposed under front portions of the sets of the rails and oriented in a direction perpendicular to a virtual plane defined by the sets of the rails, a first sprocket disposed around the axle, a second sprocket disposed adjacent to a center of a bottom of a rear end of the base and frame assembly, and a disc shaped damping member with the first sprocket mounted in its center; and a belt meshing with the first and second sprockets, the belt being parallel to the sets of the rails; wherein the pedals are secured to the belt and disposed at two sides of the first and second sprockets respectively so as to enable an optimum movement of both the pedals.

The invention has the following advantages and benefits in comparison with the conventional art:

The axle is oriented in a direction perpendicular to a virtual plane defined by the sets of the rails. The damping member is parallel to a moving direction of the sets of the rails. The base and frame assembly occupies a minimum space.

The locations of the pedals enable a maximum, optimum movement thereof.

In case the belt is broken, it is easy to replace with a new one by simply putting the new belt on the first and second sprockets in one operation rather than multiple times.

The belt has an improved flexibility so that the corresponding first and second sprockets may have a smaller diameter with a maximum damping effect being brought about.

The above and other objects, features and advantages of the invention will become apparent from the following detailed description taken with the accompanying drawings.

DETAILED DESCRIPTION OF THE INVENTION

Figure 1:
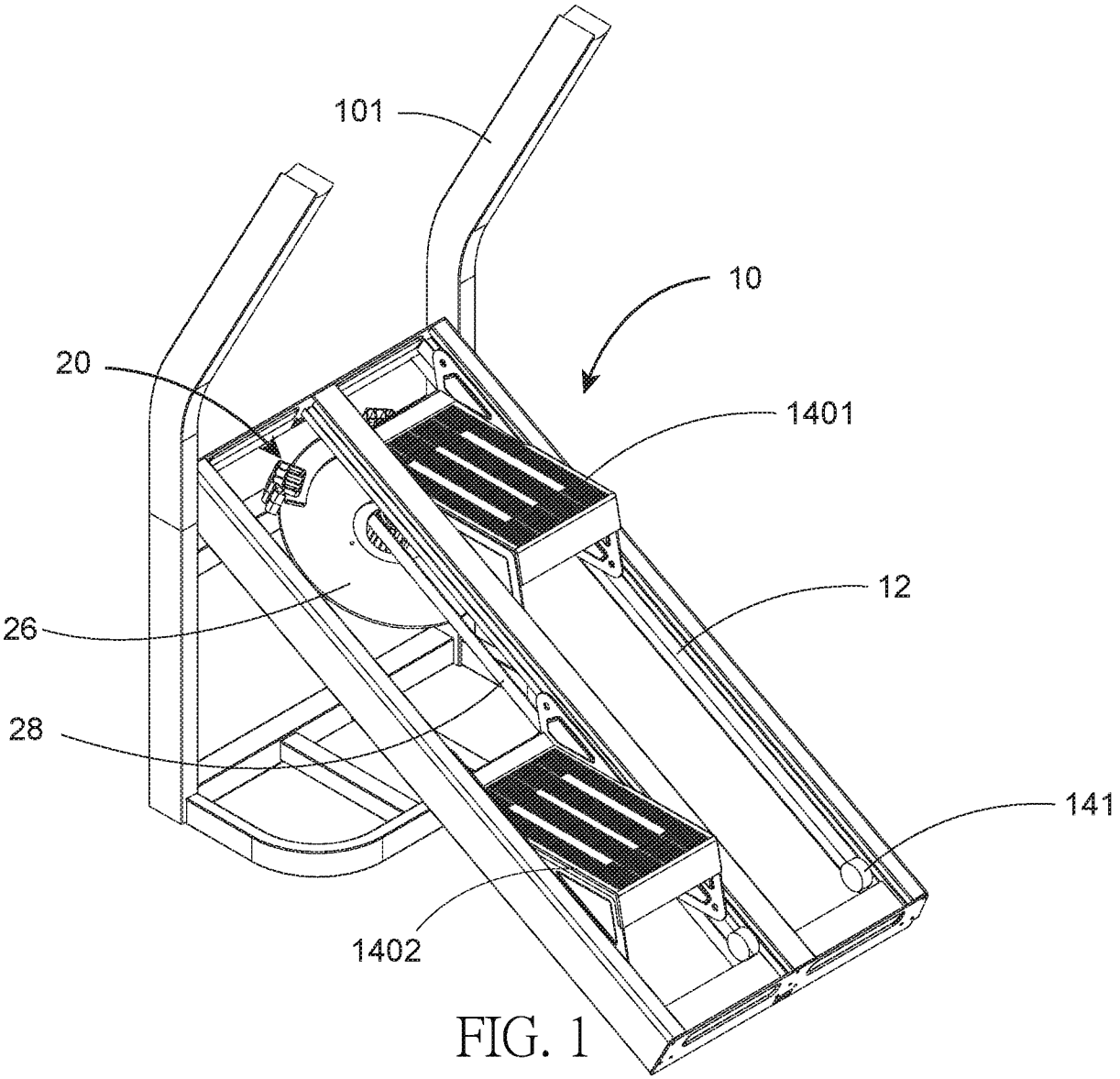
FIG. 1 is a perspective view of a climbing machine according to the invention.
Figure 2:
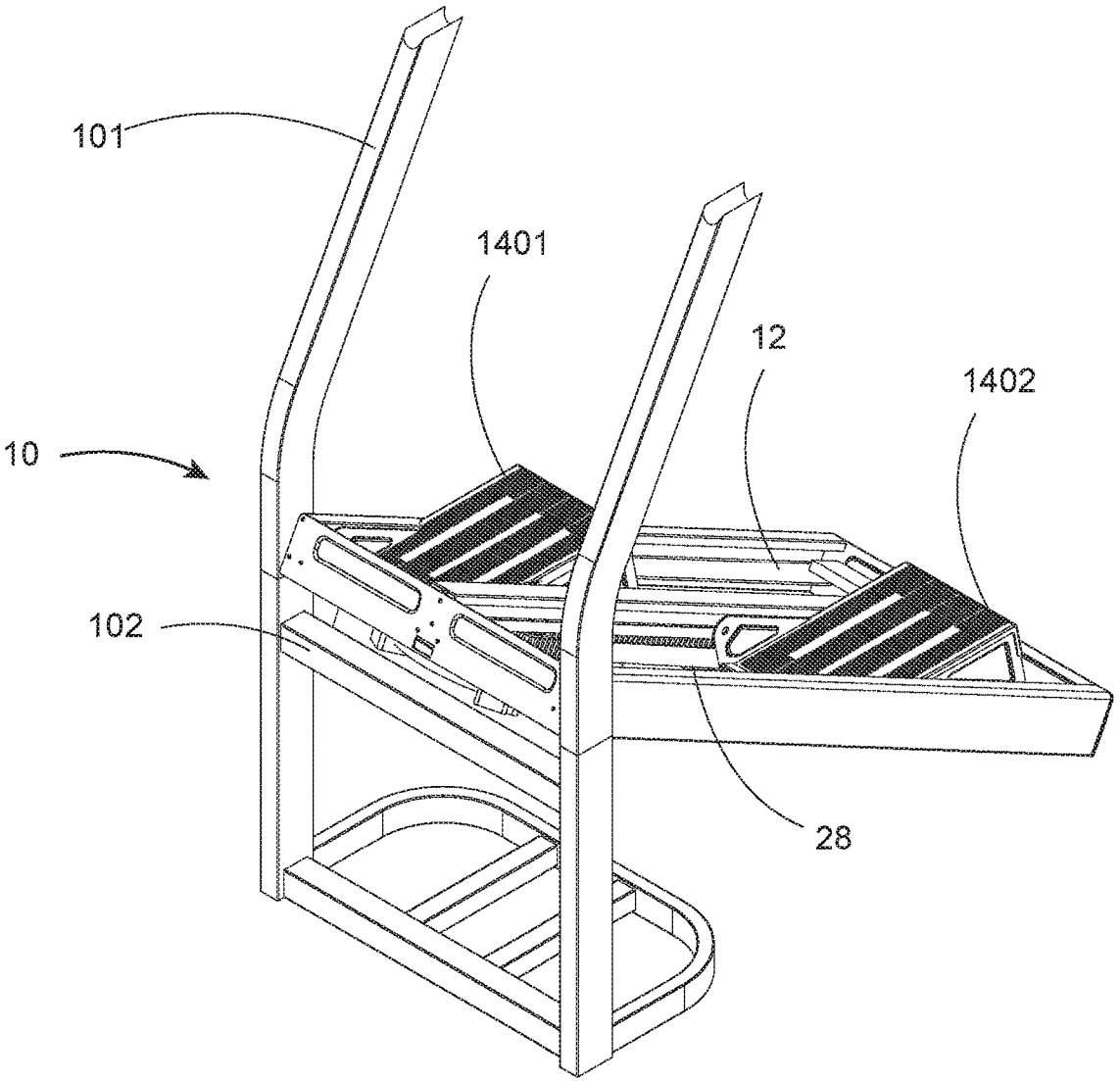
FIG. 2 is another perspective view of the climbing machine.
Figure 3:
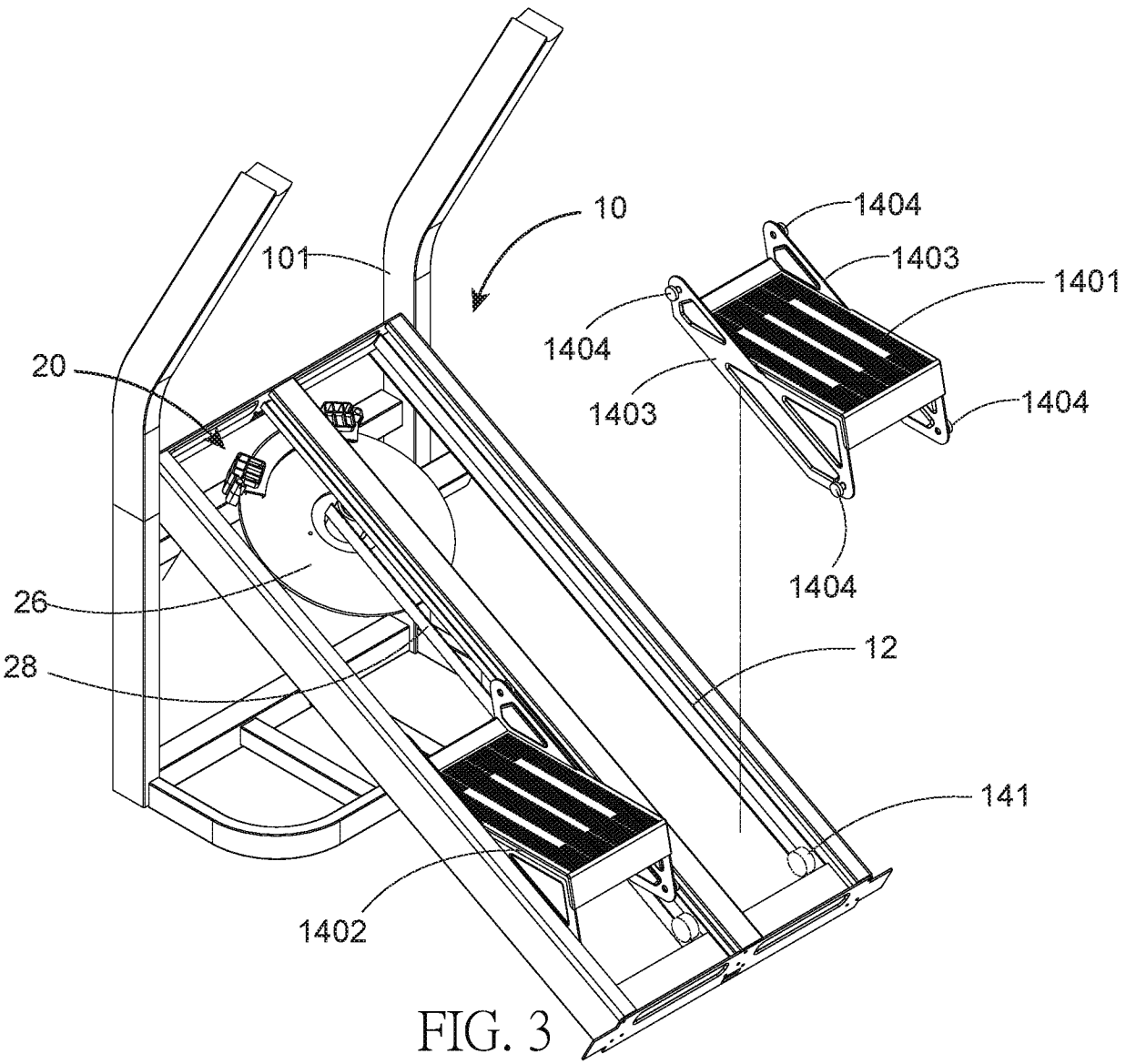
FIG. 3 is a view similar to FIG. 1 showing one pedal being detached from the climbing machine.
Figure 4:
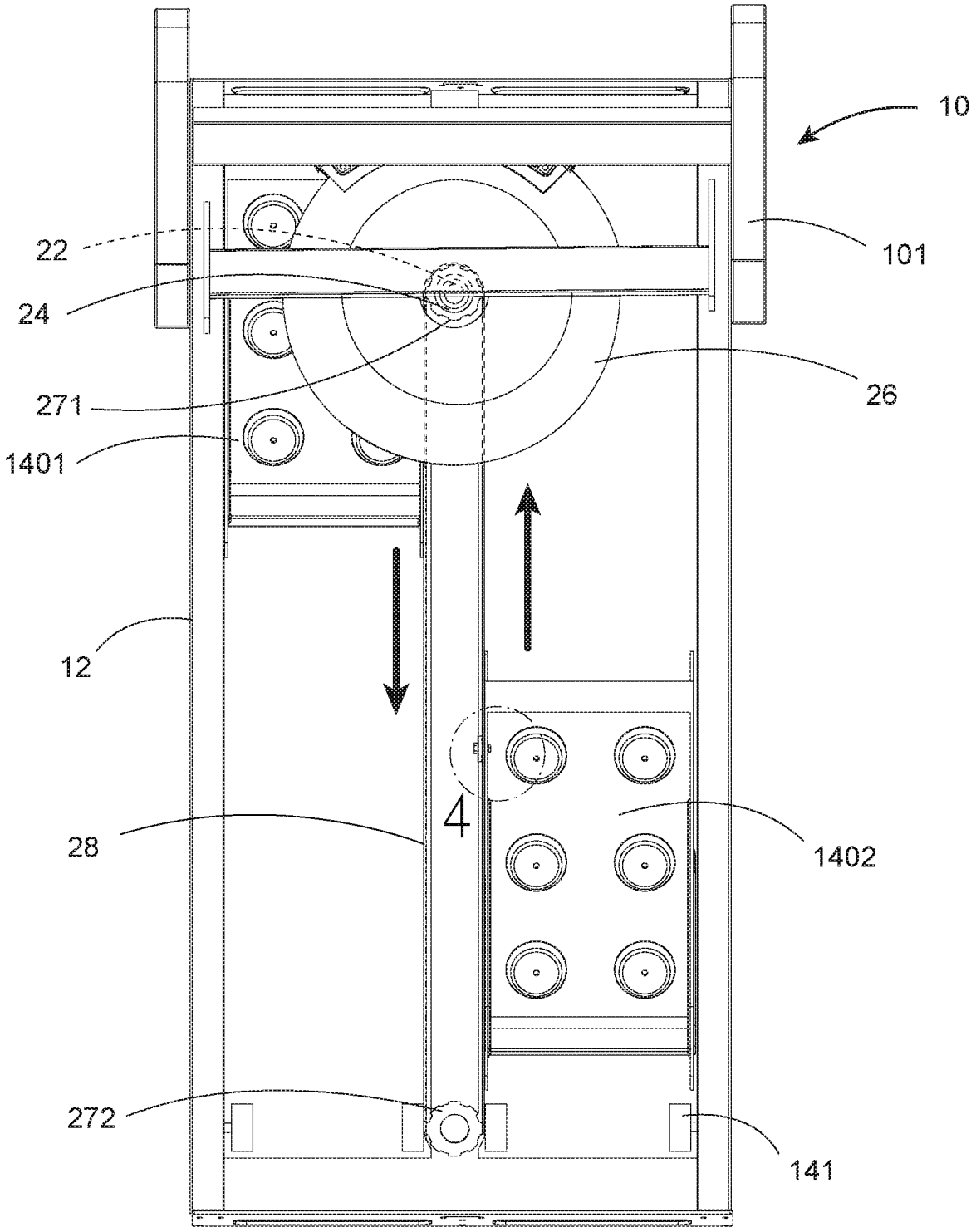
FIG. 4 is a bottom view of the climbing machine.
Figure 6:
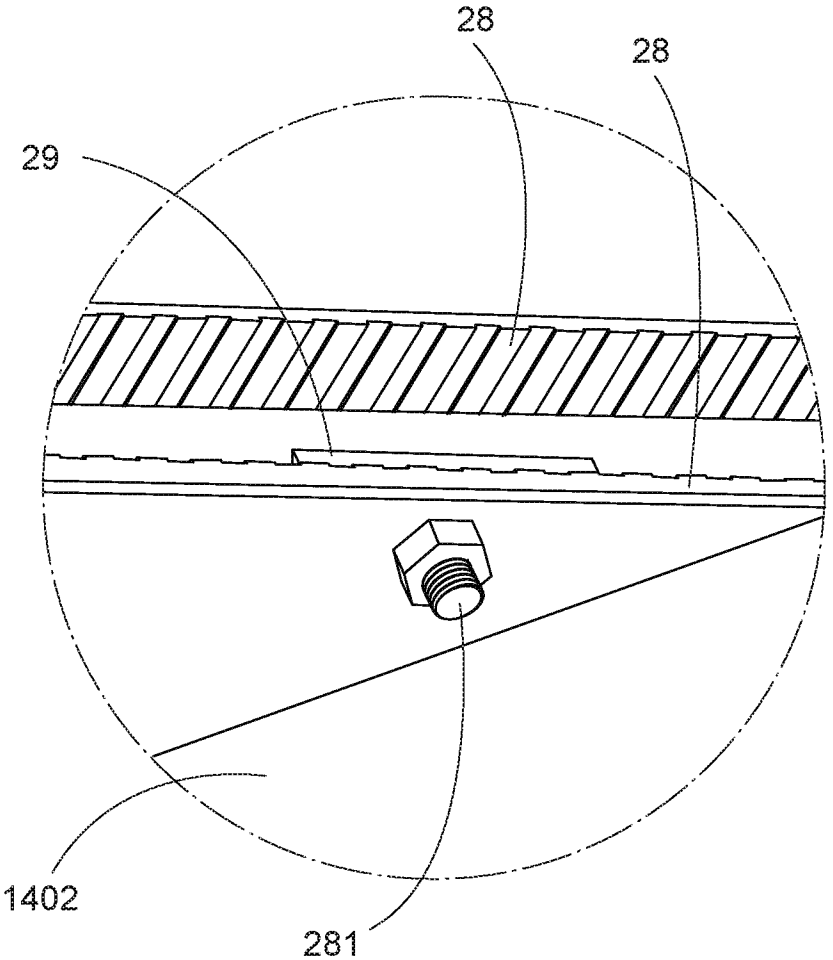
FIG. 6 is a perspective view showing the join of the belt and the pressing plate.
Figure 5:
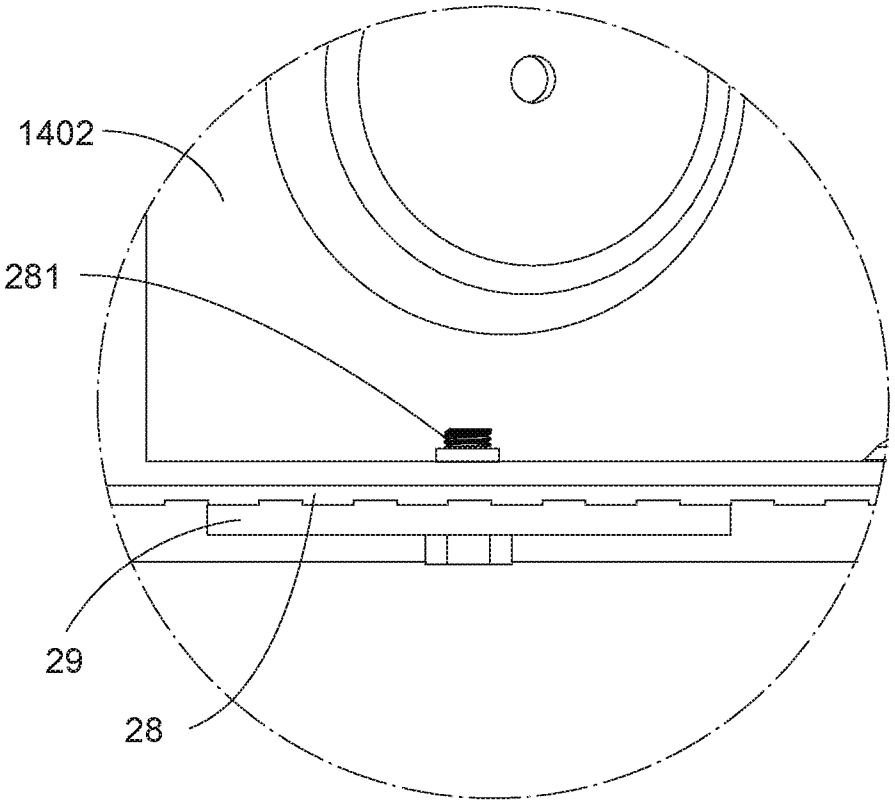
FIG. 5 is a detailed view of the area in a circle of FIG. 4 showing the join of the belt and a pressing plate.
Figure 7:
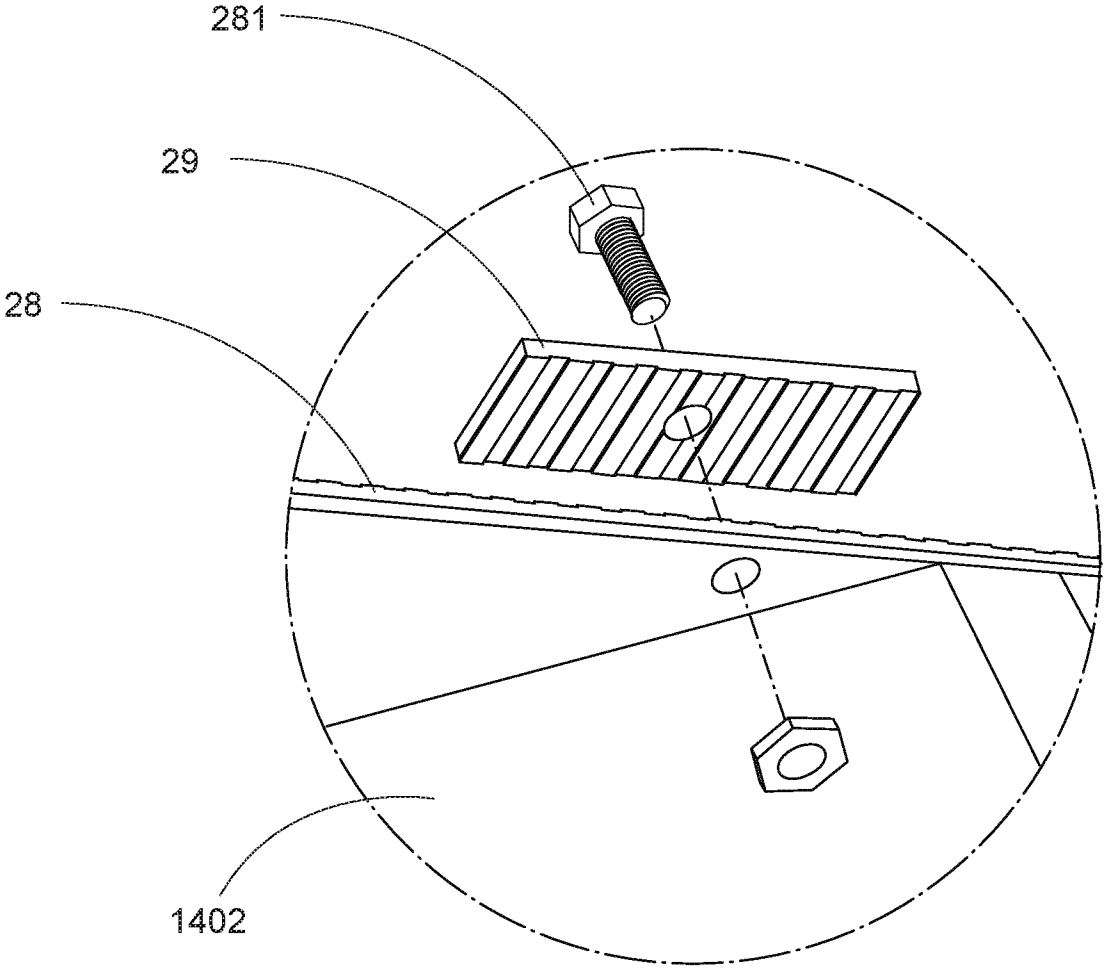
FIG. 7 is an exploded view of FIG. 6.

Referring to FIGS. 1 to 10, a climbing machine in accordance with the invention is shown. As shown in FIGS. 1 to 4 specifically, the climbing machine comprises the following components as discussed in detail below.

A base and frame assembly 10 is supported on the ground. Two handlebars 101 extend upward, rearward from the base and frame assembly 10 so that an individual may hold the handlebars 101 to keep body balance in exercise. Two sets of two inclined parallel rails 12 are provided in which each rail 12 has one end secured to a joining portion of the handlebar 101 and the base and frame assembly 10 and the other end rested on the ground. Two pedals 1401 and 1402 are slidably mounted on the sets of the rails 12 respectively. A limit member 141 is provided at a lower end of each rail 12. The limit members 141 are used to limit downward movements of the pedals 1401 and 1402 so as to prevent the pedals 1401 and 1402 from contacting bottom ends of the rails 12 in addition to buffering purpose.

The base and frame assembly 10 includes a transverse bar 102 under the joining portion of the handlebar 101 and the base and frame assembly 10 for increasing the structural strength of the base and frame assembly 10 so that the climbing machine may be used in a more stable way with greatly decreased vibration.

A transmitting device 20 for adding difficulty to motion includes an axle 22 mounted under front portions of the rails 12 and disposed in a direction perpendicular to a virtual plane defined by the rails 12, a first sprocket 271 mounted around the axle 22, a second sprocket 272 mounted adjacent to a center of a bottom of a rear end of an inclined portion of the base and frame assembly 10, a disc shaped damping member 26 with the first sprocket 271 mounted in its center so that the damping member 26 may co-rotate with the first sprocket 271, and a belt 28 having an indented inner surface meshing with the first sprocket 271 and the second sprocket 272, the belt 28 being parallel to the rails 12. The pedals 1401 and 1402 are secured to the belt 28 and disposed at two sides of the first sprocket 271 and the second sprocket 272 respectively. Upward or downward movement of both the first sprocket 271 and the second sprocket 272 rotates the belt 28. The location of the belt 28 between the pedals 1401 and 1402 enables a maximum, optimum movement of both the pedals 1401 and 1402. The rotational movement of the belt 28 rotates the transmitting device 20. And in turn, an individual using the climbing machine may, for example, raise one foot away from one pedal 1401 when the other pedal 1402 moves downward by force exerted by the other foot and vice versa. As an end, an exercise similar to mountain climbing is taken.

As shown in FIGS. 3 to 7 specifically, in response to the downward movement of one pedal 1401, the other pedal 1402 moves upward due to the rotational movement of the belt 28. For optimizing the join of the belt 28 and the pedals 1401 and 1402, a pressing plate 29 is provided on an inner surface of the belt 28 and away from the pedals 1401 and 1402. A threaded fastener 281 is driven through the pressing plate 29, the belt 28 and one of the pedals 1401 and 1402 for fastening them together. This is because the belt 28 is resilient in nature. The fastening together of the belt 28 and one of the pedals 1401 and 1402 by the threaded fastener 281 may be not reliable, secure. Thus, the pressing plate 29 is provided to have its indented surface meshing with and urging against the belt 28. As a result, the threaded fastener 281 driven through the pressing plate 29, the belt 28 and one of the pedals 1401 and 1402 is capable of fastening them together. Alternatively, the pressing plate 29 can be omitted if the belt 28 is made of a material having sufficient traction.

It is noted that the pressing plate 29 has one surface facing the belt 28 being indented, both the first sprocket 271 and the second sprocket 272 are toothed wheels, and the belt 28 has an indented surface facing the pressing plate 29. The pressing plate 29, the first sprocket 271, the second sprocket 272 and the belt 28 are joined by meshing. As a result, the belt 28 and the transmitting device 20 are more stable in operation.

As shown in FIG. 3 and FIGS. 5 to 7 specifically, the pedals 1401 and 1402 have a flat top disposed horizontally. Each of the pedals 1401 and 1402 includes two inclined sides 1403, each side 1403 having two rollers 1404 at upper and lower ends respectively, the rollers 1404 being rotatably disposed in the rail 12. The threaded fastener 281 is driven through the pressing plate 29, the belt 28 and the inclined side 1403 of one of the pedals 1401 and 1402 for fastening them together.

Figure 8:
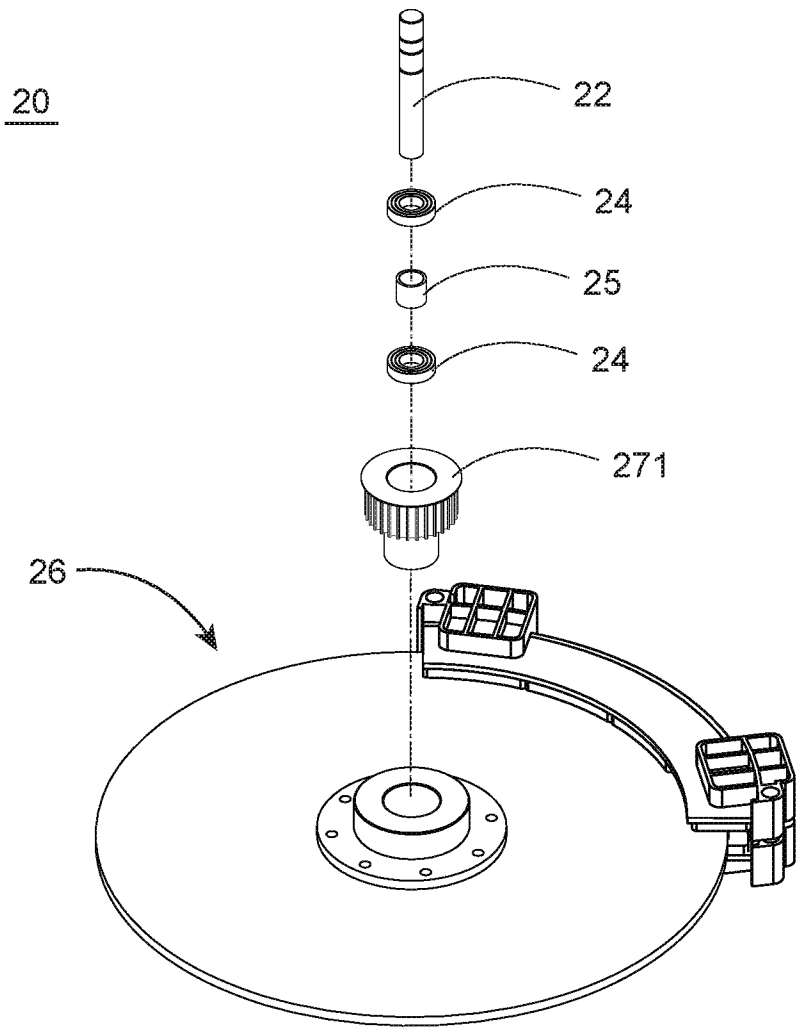
FIG. 8 is an exploded view of the transmitting device.
Figure 9:
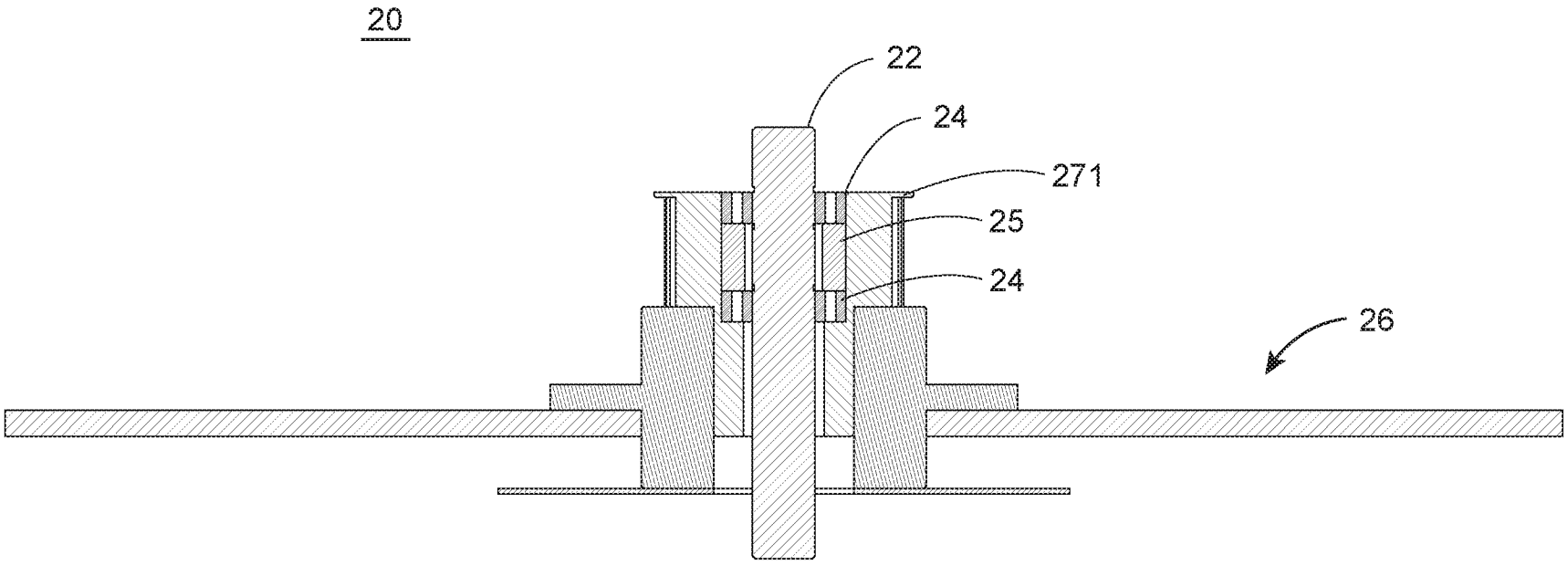
FIG. 9 is a longitudinal sectional view of the transmitting device.
Figure 10:
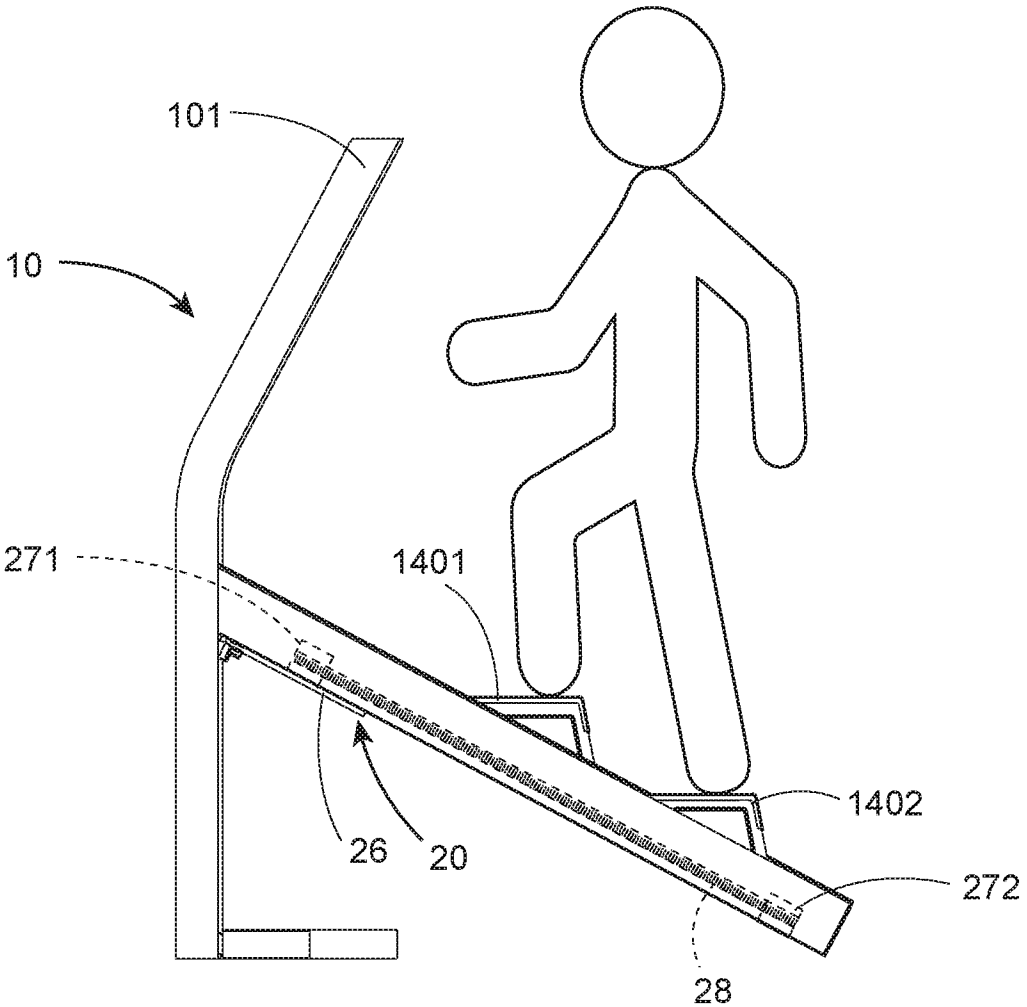
FIG. 10 is a side elevation showing an individual using the climbing machine for exercise.
Figure 11:
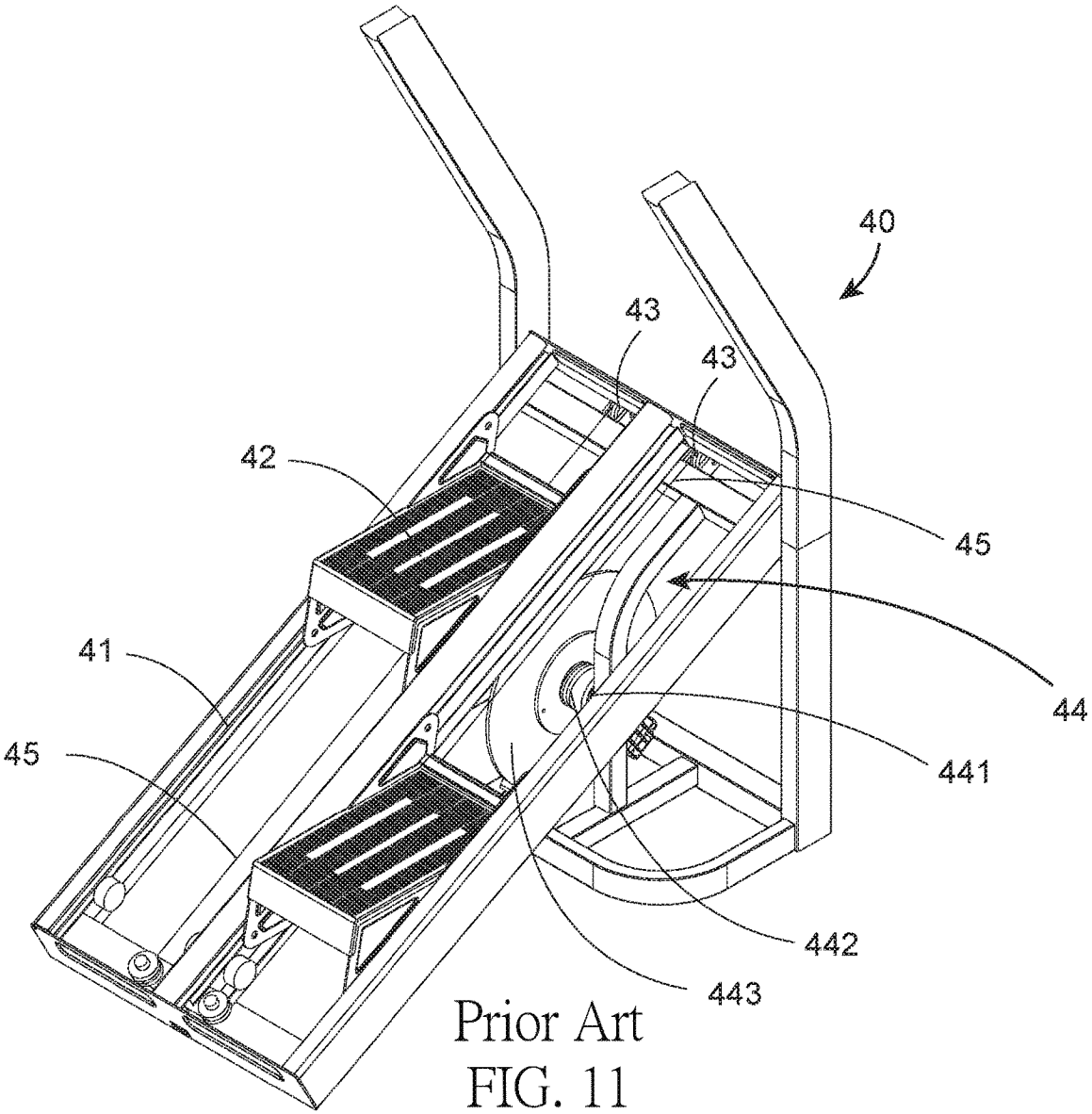
Prior Art FIG. 11
FIG. 11 is a perspective view of a conventional climbing machine.

As shown in FIGS. 8 and 9, the transmitting device 20 further comprises two bearings 24 disposed in the first sprocket 271, and a spacer 25 between the bearings 24. The axle 22 is through one bearing 24, the spacer 25, the other bearing 24 and a central hole of the first sprocket 271. The bearings 24 are fastened in the first sprocket 271. The spacer 25 is disposed between the bearings 24 for separation purpose. The bearings 24 are disposed on the axle 22. The first sprocket 271 is secured to a center of the damping member 26. The provision of the bearings 24 can reduce friction between the first sprocket 271 and the axle 22. As a result, the useful life of the first sprocket 271 is prolonged.

As shown in FIG. 10 and FIGS. 1 to 4 specifically, a rotational direction of the bearings 24 is that of the belt 28. The transmitting device 20 rotates in response to the rotation of the belt 28. When using the climbing machine, the pedals 1401 and 1402 move downward due to the weight of the individual. The individual may lift one of the feet and press one of the pedals 1401 and 1402 using other foot. As a result, one of the pedals 1401 and 1402 moves downward. When the individual uses the climbing machine to take an exercise similar to climbing a mountain, one foot presses one pedal 1401 to lower same. And in turn, the belt 28 rotates to move the other pedal 1402 upward. Further, the other foot presses the other pedal 1402 to lower same. And in turn, one pedal 1401 at lower ends of the rails 12 moves upward due to the rotation of the belt 28. By repeating above steps, an exercise similar to mountain climbing is taken. The transmitting device 20 can increase resistance to the motion, thereby increasing benefits of the exercise. Further, the increased resistance can decrease a moving speed of each of the pedals 1401 and 1402 so that the pedals 1401 and 140 can be smoothly disposed at any position. Moreover, the individual may not hold the handlebars 101 and does not worry about unstable center of gravity in exercise. In addition, both height of step and moving speed of each of the pedals 1401 and 1402 can changed based on a stepping point on the pedal and an adjustment of the resistance. It is envisaged by the invention that the climbing machine is appropriate to people of different ages and patients having injured knees. While the invention has been described in terms of preferred embodiments, those skilled in the art will recognize that the invention can be practiced with modifications within the spirit and scope of the appended claims.

What is claimed is:

1. A climbing machine, comprising:

a base and frame assembly;

two sets of two inclined parallel rails disposed on the base and frame assembly;

two pedals slidably disposed on the sets of the rails respectively;

a transmitting device including an axle disposed under front portions of the sets of the rails and oriented in a direction perpendicular to a virtual plane defined by the sets of the rails, a first sprocket disposed around the axle, a second sprocket disposed adjacent to a center of a bottom of a rear end of the base and frame assembly, and a disc shaped damping member with the first sprocket mounted in its center; and a belt meshing with the first and second sprockets, the belt being parallel to the sets of the rails;

wherein the pedals are secured to the belt and disposed at two sides of the first and second sprockets respectively so as to enable an optimum movement of both the pedals.

2. The climbing machine of claim 1, wherein the transmitting device further comprises two bearings disposed in the first sprocket, and a spacer disposed between the bearings; and wherein the axle is disposed through one bearing, the spacer, and the other bearing.

3. The climbing machine of claim 1, further comprising a pressing plate disposed on an inner surface of the belt and away from the pedals, and at least one threaded fastener each driven through the pressing plate, the belt, and one of the pedals for fastening them together.

4. The climbing machine of claim 3, wherein the pressing plate has an indented surface facing the belt, both the first and second sprockets are toothed wheels, and the belt has an indented surface facing the pressing plate; and wherein the pressing plate, the first and second sprockets and the belt are joined by meshing.

5. The climbing machine of claim 3, wherein the pedals have a flat top disposed horizontally; wherein each of the pedals includes two inclined sides each having two rollers at upper and lower ends respectively, each roller being rotatably disposed in the rail; and wherein each of the at least one threaded fastener is driven through the pressing plate, the belt, and the inclined side of one of the pedals for fastening them together.

6. The climbing machine of claim 1, wherein both the first and second sprockets are toothed wheels; wherein the belt has an indented surface; and wherein the first and second sprockets and the belt are joined by meshing.

7. The climbing machine of claim 1, wherein the base and frame assembly includes two handlebars extending upward.

8. The climbing machine of claim 1, further comprising a plurality of limit members each disposed at a lower end of each rail and being configured to limit a downward movement of each of the pedals.

9. The climbing machine of claim 1, wherein the base and frame assembly includes at least one transverse bar.

* * * * *